US005453064A

United States Patent [19]

Williams, Jr.

[11] Patent Number: 5,453,064

[45] Date of Patent: Sep. 26, 1995

[54] EXERCISE GLOVE INCORPORATING RODS WHICH OFFER RESISTANCE TO MOVEMENT OF FINGERS, HANDS, OR WRISTS

[75] Inventor: Charlton H. Williams, Jr., Seale, Alabama

[73] Assignee: Natraflex Systems, Inc., Seale, Ala.

[21] Appl. No.: 923,044

[22] Filed: Jul. 31, 1992

[51] Int. Cl.[6] ..... A63B 23/16

[52] U.S. Cl. ..... 482/47; 482/49; 482/124; 2/161.1

[58] Field of Search ..... 2/160, 161 A, 2/161 R, 255–258, 161.1, 161.6, 170, 161.2, 161.4, 161.6, 162, 166, 255, 256; 482/47, 49, 44, 48, 124; 128/26, 878, 879; 602/21, 22; 273/188 R, 189 R, 189 A; 473/59; D2/616, 617, 620; D21/198; 601/40

[56] References Cited

U.S. PATENT DOCUMENTS

| | | | |
|---|---|---|---|
| 272,951 | 2/1883 | Gardner . | |
| 425,887 | 4/1890 | Kohler . | |
| 494,197 | 3/1893 | Hall . | |
| 818,332 | 4/1906 | Anson | 482/48 |
| 867,981 | 10/1907 | Krizek . | |
| 1,471,948 | 10/1923 | Cox et al. | 602/21 |
| 1,797,057 | 3/1931 | Foulke | 602/21 |
| 2,025,357 | 12/1935 | Pagan | 2/161 R |
| 2,108,236 | 2/1938 | Scott . | |
| 2,154,197 | 4/1939 | Callaway . | |
| 2,369,115 | 2/1945 | Bloom . | |
| 2,468,580 | 4/1949 | Weis et al. | 2/255 |
| 2,695,999 | 12/1954 | Arnold . | |
| 2,794,638 | 6/1957 | Risher . | |
| 3,030,633 | 4/1962 | Chalfin | 2/258 |
| 3,031,680 | 5/1962 | Compiano . | |
| 3,164,841 | 1/1965 | Burtoff . | |
| 3,344,436 | 10/1967 | Stubbs . | |
| 3,347,547 | 10/1967 | Hynes . | |
| 3,533,405 | 10/1970 | Collins . | |
| 3,581,312 | 6/1971 | Nickels . | |
| 3,588,917 | 6/1971 | Antonious . | |
| 3,606,614 | 9/1971 | Dimitroff . | |
| 3,643,386 | 2/1972 | Grzyll . | |
| 3,890,649 | 6/1975 | Diggins . | |
| 3,944,220 | 3/1976 | Fasano . | |
| 4,138,108 | 2/1979 | Robinson | 273/189 A |
| 4,309,991 | 1/1982 | DeMarco . | |
| 4,330,120 | 5/1982 | Netti . | |
| 4,400,831 | 8/1983 | Rietz . | |
| 4,438,532 | 3/1984 | Campanella . | |
| 4,502,688 | 3/1985 | Papp . | |
| 4,525,877 | 7/1985 | Chong . | |
| 4,546,495 | 10/1985 | Castillo . | |
| 4,675,914 | 6/1987 | Mitchell | 2/166 |
| 4,701,963 | 10/1987 | Overton . | |
| 4,781,178 | 11/1988 | Gordon | 602/22 |
| 4,829,604 | 5/1989 | Allen . | |
| 4,830,360 | 5/1989 | Carr . | |
| 4,843,651 | 7/1989 | Gramza . | |
| 4,854,309 | 8/1989 | Elsey | 602/21 |
| 4,863,159 | 9/1989 | Brown, Jr. | 482/126 |
| 4,905,321 | 3/1990 | Walunga . | |
| 4,919,966 | 4/1990 | Shlenker | 2/161 R |
| 5,019,096 | 5/1991 | Fox, Jr. et al. | 604/265 |
| 5,033,119 | 7/1991 | Wiggins . | |
| 5,113,526 | 5/1992 | Wang | 2/161.6 |
| 5,113,849 | 5/1992 | Kuiken et al. | 128/26 |
| 5,135,217 | 8/1992 | Swain . | |
| 5,156,168 | 10/1992 | Canterna | 602/21 |

FOREIGN PATENT DOCUMENTS

| | | | |
|---|---|---|---|
| 0484487 | 10/1917 | France | 482/47 |

*Primary Examiner*—Richard J. Apley
*Assistant Examiner*—Jeanne M. Clark

[57] ABSTRACT

A device for exercising the fingers, hands, wrists and forearms of a user. The device incorporates flexible resilient rods made of a material such as a composite. The flexural strength of the rods creates the exercising resistance. The rods extend parallel to the hand of the user and therefore allow the user to perform other functions with his or her hands while wearing the device. The rods and the device may incorporate antimicrobials to prevent the spread or growth of microorganisms.

9 Claims, 3 Drawing Sheets

EXERCISE GLOVE INCORPORATING RODS WHICH OFFER RESISTANCE TO MOVEMENT OF FINGERS, HANDS, OR WRISTS

FIELD OF THE INVENTION

This invention relates to exercise fitness equipment, and more specifically relates to the use of composites in gloves to offer resistance to individual fingers for the purpose of exercising those fingers or to the hand for the purpose of exercising the wrist and forearm.

BACKGROUND OF THE INVENTION

Few muscles are used as often as the wrist, forearm and hand muscles (hereinafter referred to collectively as "lower arm muscles"). Each time a person lifts or grabs an object, these muscles come into use. The constant use of the functions of the hands makes the condition and ability to use the hands extremely important.

Despite this importance, there are very few ways to develop, exercise or rehabilitate the lower arm muscles. One past method of exercising the wrists and forearms is by performing "wrist curls". A wrist curl begins by a user holding weights in one or both hands with the forearms extending substantially perpendicular from the body. The wrists are then twisted back and forth, alternating between forcing the weights upward and lowering the weights. Other methods of exercising the lower arm muscles include squeezing resilient objects such as tennis balls or twisting handles which offer resistance. Although each of these exercises may offer exercise of the wrist and hands, the equipment used is often bulky or cumbersome or difficult to handle. There is a need for a lightweight device for exercising the lower arm muscles of the person which is not difficult to handle.

Other problems may exist if it is the finger muscles the user wishes to develop. Rehabilitation may require exercising individual fingers or exercising some fingers more than others. Most exercises do not allow for isolation of individual fingers. Moreover, a user attempting to exercise the fingers using objects such as tennis balls may end up "cheating" or using one or two more dominant fingers when squeezing the resilient objects. There is a need for a lightweight means of exercising the hands or wrists of the person which could isolate individual fingers or offer different resistances for different fingers.

Most of the prior apparatuses used to exercise the lower arm muscles typically resist in a linear manner the force applied by the exerciser. In the linear systems, the resistance applied to the exerciser is constant regardless of the position of the exercise equipment relative to the exerciser's body. However, recently it has been discovered that optimum exercise results may be obtained by the use of variable resistance exercise equipment. The equipment applies a variable or non-linear resistance to the exerciser during the motion associated with an exercise movement. The advantages of variable resistance exercise equipment are discussed in U.S. Pat. No. 4,863,159 to Brown, Jr. There is a need for a variable resistance exercising device for the lower arm muscles of a person.

The space industry has offered a new problem in terms of muscle development. Specifically, when astronauts are in space, their muscles tend to degrade or atrophy because of the lack of gravity or lack of resistance applied by the thinner atmosphere. The lower arm muscles are but a few of the muscles which suffer from this phenomenon. Because of the limited space in the spacecraft, exercising equipment must be of limited size. Also, because of the limited gravity in space and the advantages of keeping the spacecraft light, the exercising device needs to not rely on its weight to provide resistance.

A continuing concern with exercising devices is the spread of germs or disease, especially when the devices are used in an institutional environment. The germs may spread through the exercising equipment by contact of different people with the equipment or by microorganisms passing through the air. There is a need to provide an exercising device for the lower arm muscles which may be free from contaminants and which could destroy or inhibit growth of other microorganisms which come into contact with the exercising device.

Thus, there is a need in the area of exercise equipment for the lower arm muscles for a lightweight exercising device which works without using gravity as a means for resistance. In addition, the device needs to exercise each of the fingers of the hand individually and offer variable resistance. The device also needs a means of being offered in a germ-free state. Preferably, the device could offer exercise without impeding normal use of the hands.

SUMMARY OF THE INVENTION

The present invention solves the above-mentioned problems by introducing flexible composites for use in exercising the fingers, hands, wrists, and forearms of a user. The composites are lightweight, offer many cycles, and work without using gravity as a means for resistance. The composites may be removed and replaced with other flexible materials having different flexural strengths to offer different resistances to different fingers. In addition, the composites offer a means of variable resistance exercising to the lower arm muscles. The composites may be preformed in a bent condition such that at the beginning of the exercise the hand is closed and, during performance of the exercise, the hand is extended against the resistance of the composites. Antimicrobials may be added to the composites or the gloves to make them germ-resistant.

More specifically stated, the present invention provides a device for exercising the hand of a user, the device comprising a plurality of flexible, resilient rods which extend substantially parallel to the hand of the user, a device for associating the rods with at least one finger of the hand to be exercised, and a device for associating the rods with another part of the body of the user. The resistance to bending of the rods restricts opening or closing of the hand and causes the hand or fingers to be exercised. The rods may be associated with the wrist by being attached to a wrap extending around the wrist and may be associated with the fingers by being attached to a wrap which extends around the fingers. The rods may extend across the back of the hand, the front of the hand, or between the fingers of the user. The composite may be formed so that when in a relaxed position, the hand of the user is closed and exercising occurs by extending the fingers. In a preferred embodiment of the invention, the rods are formed from a flexible composite with a suitable toughness to provide a useful flexural fatigue life.

Stated in greater detail, a preferred embodiment of the exercising device has the rods incorporated into a glove. The rods may extend from a wrap in the glove incorporated to extend around the wrist of the user and may extend to the fingertips of the user. To provide different resistances for each of the fingers, different rods with varied flexural strengths could be used in the glove. If a composite with a low flexural strength is used, the gloves may be worn while performing everyday tasks and may help prevent hand or wrist problems such as carpal tunnel syndrome.

The glove may include sleeves so that different rods may be inserted and removed to provide different resistances for the fingers. In addition, two or more of the rods may be inserted into a single sleeve in the glove to increase the resistance. Antimicrobials may be introduced into the composites and the glove to make them germ-free.

Another preferred embodiment of the exercising device includes a flat composite piece which is stamped or molded to include a rod for more than one finger. The piece may be attached directly to the hand or may be inserted into a sleeve in a glove.

Still another embodiment of the present invention provides a device for exercising the wrists or forearms of a user, the device comprising a plurality of flexible, resilient rods which extend substantially parallel to the wrist of the user in association with the corresponding hand of the user, and an element for associating the rods with part of the body of the user. The resistance to bending the rods restricts movement of the hand relative to the forearm and causes the wrists and forearms to be exercised. The rods may extend across the back of the hand, the bottom of the hand, or either side of the hands. The composite may be preformed in a bent position so that resistance is encountered when the user attempts to straighten the wrist. In addition, the rods may extend to the fingertips so that the hand and fingers may receive exercise as well. Alternatively, different rods may be used for the hands and the wrists for varied resistances. The device may be used to strengthen the muscles in the forearm to prevent or rehabilitate tendon and muscle injuries such as tennis elbow and golfer's elbow.

Because of the construction of the glove, it may act as a support for the wrist, a sports glove, an exercising glove, and a knuckle protector.

Therefore, it is an object of the invention to provide an improved exercising device for the lower arm muscles of a user.

It is a further object of the present invention to provide an exercising device for the lower arm muscles which is of variable resistance.

Another object of the present invention is to provide an exercising device for the lower arm muscles which does not rely on gravity.

Yet another object of the present invention is to provide an exercising device for the lower arm muscles of a user which may be used in space.

A further object of the present invention is to provide an exercising device for the lower arm muscles which is antimicrobial.

Still another object of the present invention is to provide an exercising device which may offer different resistances to each of the fingers of a hand.

It is a further object of the present invention to provide an exercising device for the lower arm muscles of a user which provides exercise for the hands by either contracting or making a fist of the hand or by extending the fingers of the hand.

Another object of the present invention is to provide a device which may exercise or rehabilitate the lower arms of a user while still leaving these hands free to do everyday tasks.

Other objects, features and advantages will become apparent upon consideration of the following detailed description of the invention when taken in conjunction with the drawing and the appended claims.

DESCRIPTION OF THE PREFERRED EMBODIMENT

Figure 1:
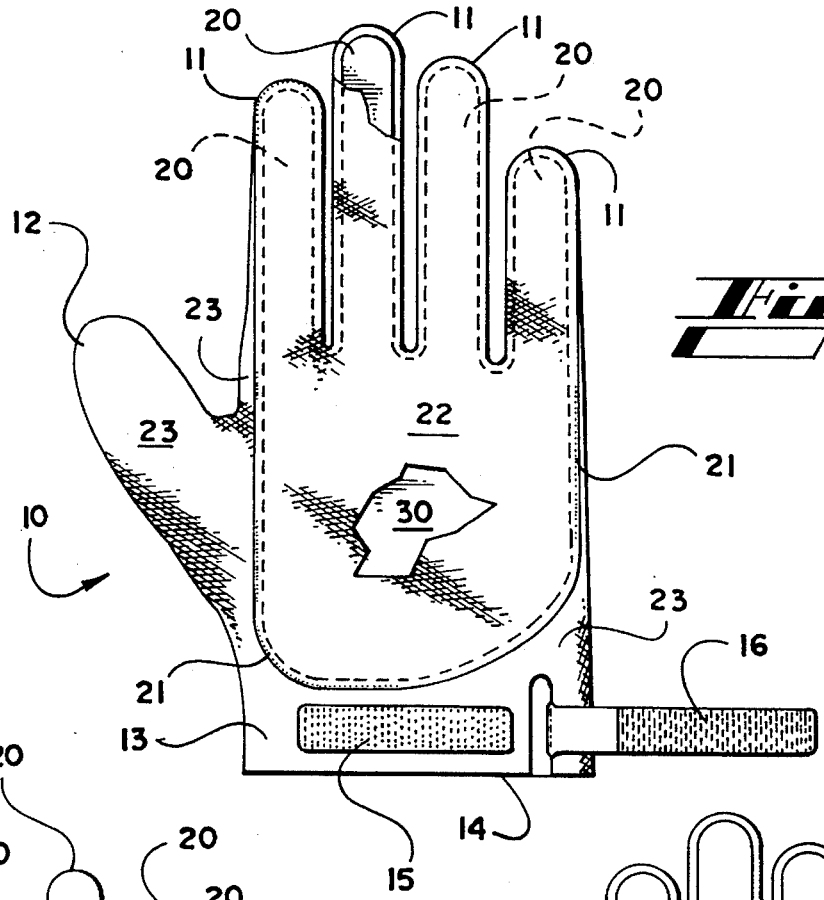
FIG. 1 is a pictorial view of a glove embodying the present invention.

Referring now to the drawing, in which like reference numerals represent like parts throughout the several views, FIG. 1 shows a glove 10 incorporating the flexible, resilient rods 20 of the present invention. The glove includes finger elements 11, a thumb element 12 and a palm 13. Although the device shown does not incorporate rods extending up the thumb, it is to be understood that exercise for the thumb could be easily provided by the addition of a fifth rod. The glove 10 preferably includes a wrist wrap 14 for holding the rods 20 near the back of the hand, as is explained below. The wrist wrap is closed by a hook-and-loop closure of the standard type. In the embodiment shown, the hook closure 15 is shown on the body of the glove and the loop closure 16 is shown on the wrist strap.

The rods 20 of the preferred embodiment are preferably formed from a hardenable mixture of filaments or fibers saturated in a resin system. However, the rods 20 may be made of any other resilient, flexible material with a suitable toughness to give a useful flexural fatigue life, such as advanced composite thermoplastics, thermosets, engineered plastics, or fiber reinforced plastics. Preferably, the rods are formed from Owens-Corning S2-glass® with a matrix material of an epoxy or a resin. The rods 20 in FIG. 10 comprise about 65 to about 70 volume percent S 2-glass in an epoxy matrix, giving the rods a desirable flexural strength. In the embodiment shown, the rods comprise 65 volume percent S2-glass. The S2-glass gives high flexibility as well as extended fatigue life. The relationship of the rods 20 with the hand is such that the rods 20 extend the length of the fingers down to the general vicinity of the wrist. The rods resist movement of the fingers when the user attempts to clench his hand to make a fist or extend his fingers beyond parallel with the hand.

Figure 2:
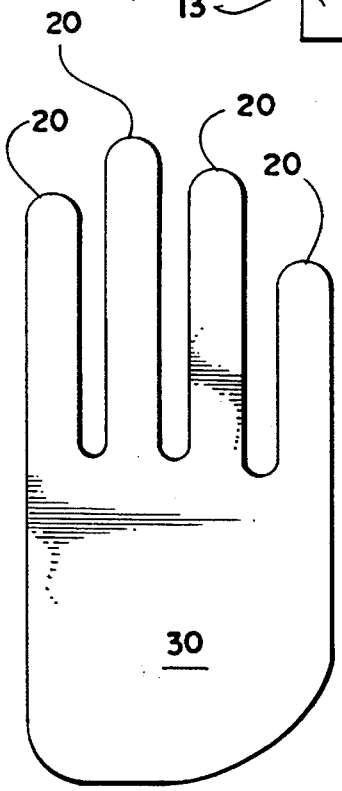
FIG. 2 is a pictorial view of a removable plate including rods for installing in a glove which embodies the present invention.

In the embodiment shown in FIG. 1, composites are used to form a flat plate 30 which extends up each finger. The plate includes the rods 20. An example of such a plate 30 is shown in FIG. 2. The plate is formed by extruding or pultruding a flat sheet of the composite and stamping out the desired shape. Alternatively, the plate may be molded. When the plate 30 is used, the rods 20 begin at a region corresponding generally to the fingertips and extend down to and become a pan of the palm area of the plate. The plate is formed in a straight or flat relationship to the hand so as to give a progressive resistance to a user attempting to clench the hand into a fist. Thin, flat composites are used so that the rods may best conform to the hand and splintering of the flexible rods is avoided. The composites are preferably 3/16 to 9/16 inches wide, 6 to 8 inches long, and 0.010 to 0.040 inches thick. It is to be understood that the rods 20 do not have to be molded in one piece but may comprise different composites for each finger, as is described below. In addition, any number of composites may be used with each finger and the flexural strength of these composites may be varied so as to offer resistance for recreational, advanced, professional, rehabilitational, or orthopedic uses.

To facilitate the best exercising, the rods 20 preferably are covered by a substantially inextensible material 22, such as leather. Padding is used in the knuckle area to prevent damage to the knuckle. The rods 20 are incorporated into the glove by being fitted between two layers of the substantially inextensible material. The padding may be inserted between the layers. In the embodiment shown in FIG. 1, sewing lines 21 extend around the rods along the length of the rods holding the layers together and attaching the two layers to the rest of the material 23 used in the glove. Preferably, a moderately extensible material 23, such as a nylon knitted fabric, is used in the regions of the glove not covered by the material 22. This moderately extensible material is used because of the different ways that the hand and the rods bend: the fingers bend at hard angles from each of three joints and the rods generally flex to a smooth curve. Use of a totally inextensible material could cause the user to injure the knuckles, break the rods, or tear the glove material. A completely elastic material could cause all of the movement of the hand to be transferred to elastic portions of the glove instead of being applied to overcome the flexural strength of the rods 20. With the proper elasticity of the glove material, the flexural strength and resistance of the rods may offer the maximum resistance to the fingers without causing damage or injury. To further facilitate maximum resistance, the wrist strap may be widened so as to extend across the back of the hand over the ends of the rods so as to hold them in place. This wrap could have the proper elasticity to allow the rods to extend the proper distance away from the back of the hands.

Figure 3:
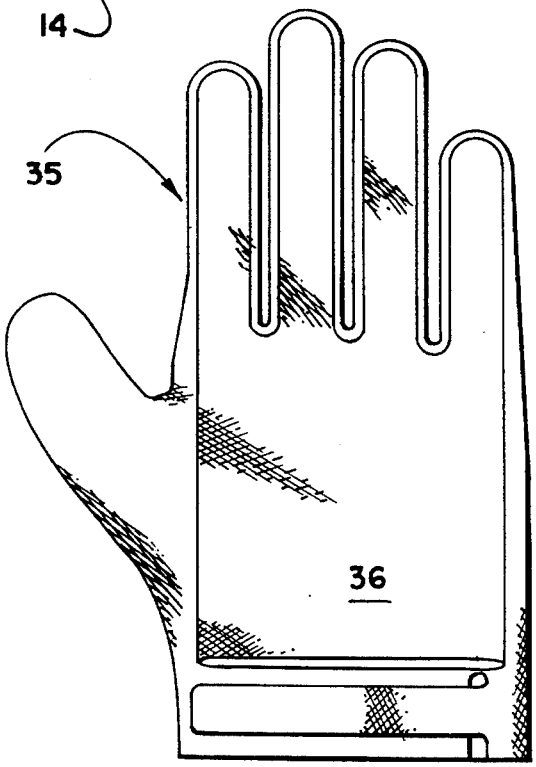
FIG. 3 is a pictorial view of a glove including a sleeve for inserting the plate of FIG. 2.

The insert of FIG. 2 may be designed so as to be placed in a sleeve in a glove 35 as is shown in FIG. 3. The insert 30 is formed so as to slide into a sleeve 36 on the glove 35 and is held in that position during exercising of the hand. Different inserts may be placed in the glove so as to vary the resistance of the exercise and possibly vary the resistance for individual fingers.

Figure 4A:
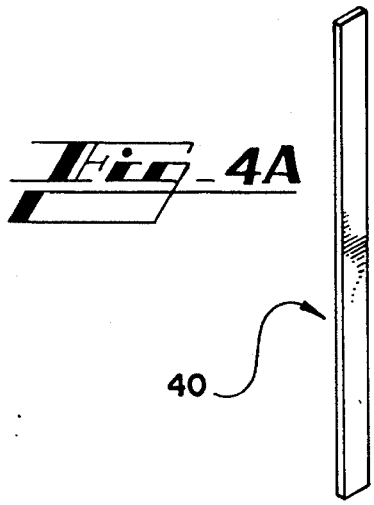
FIG. 4A is a pictorial view of a removable rods for inserting in a glove which embodies the present invention.
Figure 4B:
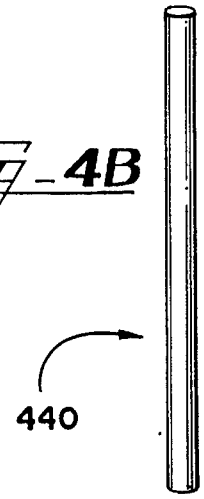
FIG. 4B is a pictorial view of a round rod to be used in an embodiment of the present invention.
Figure 5:
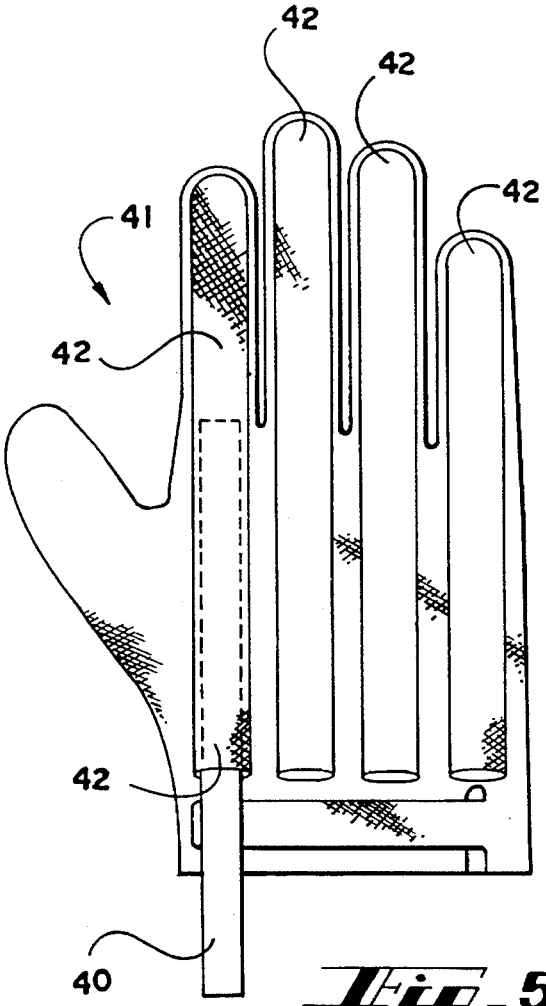
FIG. 5 is a pictorial view of a glove with sleeves for inserting rods similar to those shown in FIG. 4A.

Alternatively, a glove 41 may be made such as shown in FIG. 5 wherein separate rods 40 (shown in FIG. 4A) may be employed for each finger. The rods are inserted into sleeves 42 on the glove 41. These rods preferably would be of the same composition and dimensions as the rods 20 in FIG. 1. Like the rods 20, each insert 40 extends from an area corresponding to the fingertips to an area corresponding with the wrist. A round rod 440, shown in FIG. 4B, preferably having the same composition as the flat rods 40, could also be used in the sleeves 42. The round rods 440 preferably would have a diameter of 1/32 to 3/32 inches. Increasing the diameter increases the flexural strength of the rods and therefore increases the workout to the fingers. Each of these rods 40 and 440 are made to slide into the sleeves 42 in the glove 41 of FIG. 5. It may be necessary to reinforce the sleeves 42 on the glove 41 so that the composite rods will not extend out of the sleeves or tear the sleeves. The reinforcement could be of a flexible material such as leather, Mylar® polyester film, or plastic.

Figure 6:
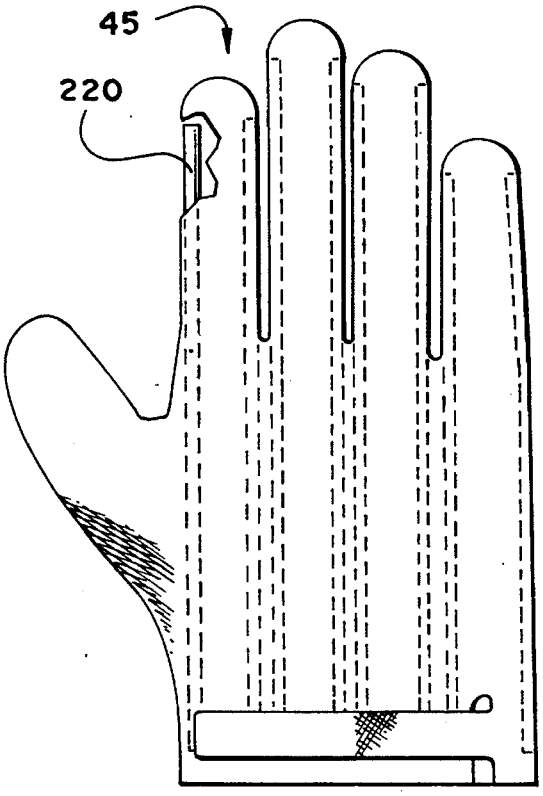
FIG. 6 is an alternative embodiment of the present invention wherein the round rods such as is shown in FIG. 4B extend between the fingers of the user.

FIG. 6 shows another glove 45 embodying the present invention wherein composite rods 220 extend down the sides of the fingers and are preferably round in shape such as the rods 440 in FIG. 4B. The rods may extend down both sides of the fingers to the wrist, as is shown in FIG. 6, or may extend down just one side. The composites are preferably sewn into the leather. Another device could incorporate both the flat pieces extending down the back of the hand (described above) and the round rods extending up the fingers. This embodiment could offer the greatest amount of resistance for the user.

Figure 7:
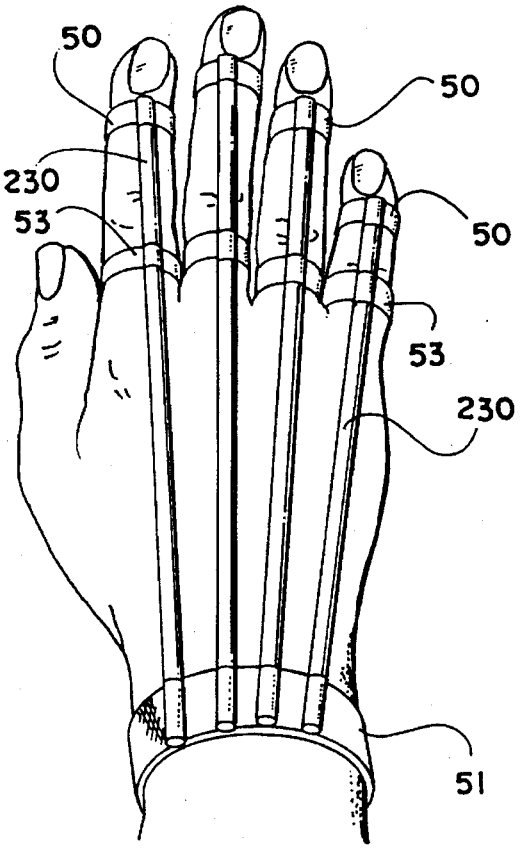
FIG. 7 is another embodiment of the present invention wherein round rods such as is shown in FIG. 4B are attached directly to the wrist and the fingertips of the user and extend across the back of the hand of the user.
Figure 8:
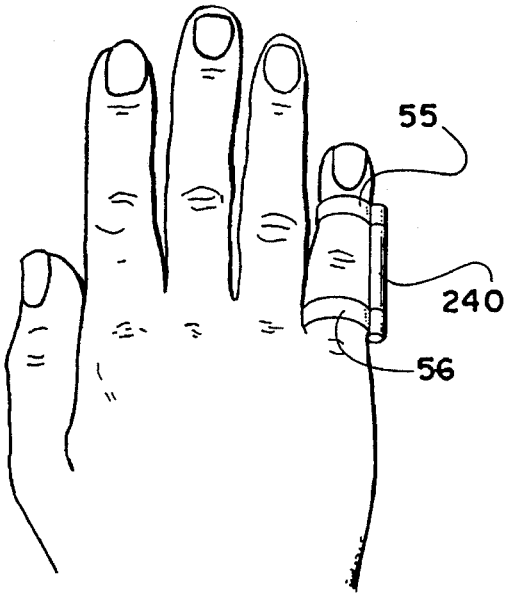
FIG. 8 is another embodiment of the present invention wherein a round rod such as is shown in FIG. 4B is attached to a finger in two positions.

It is to be understood that the exercising device may be made without a glove, as is shown in FIG. 7. In FIG. 7, there are shown rods 230 extending down the fingers to the wrist and attached to the finger tips by a wrap at 50 and attached to the wrist by a wrap at 51. An additional wrap is preferably added to each finger at 53 to prevent damage to the knuckles and to help position the rods 230. These rods may be either round or flat in shape. Similarly, rods may be strapped to individual fingers as is shown in FIG. 8. In FIG. 8, the rod 240 is attached at the finger tip with a wrap 55 and at the finger base with a wrap 56. As with the embodiment shown in FIG. 8, the rods may be round or flat in shape.

Figure 9:
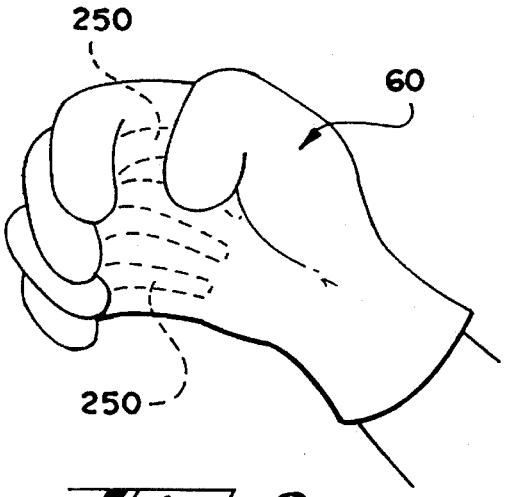
FIG. 9 is another embodiment of the present invention wherein rods are preformed in a bent position such that the hand of the user is closed when the rods are in a relaxed position and resistance occurs when the user extends the fingers and opens the hand.

A flexible rod of the present invention may also be preformed in a bent position, as is shown in FIG. 9. In this manner, the hand starts in a clenched or closed position and the rod 250 resists extension of the hand to the normal or laid out position. These rods may be incorporated into a glove 60 as is shown in FIG. 9 or could be formed to slide into sleeves on a glove.

Figure 10:
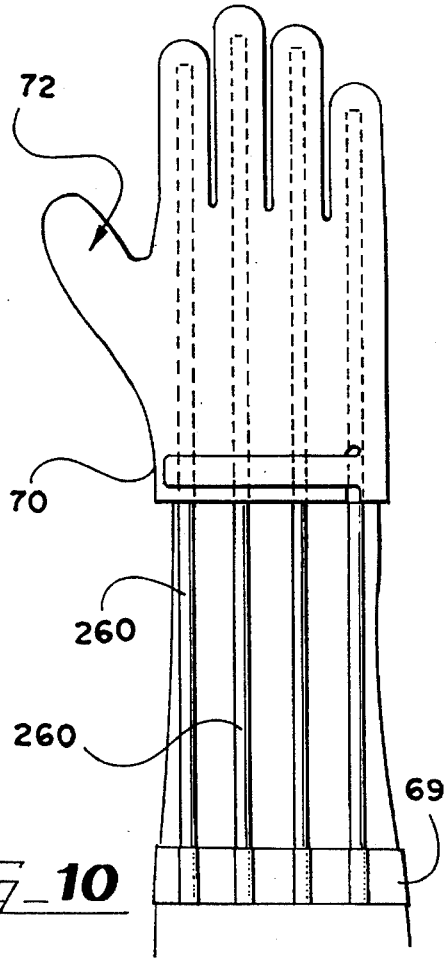
FIG. 10 is an alternative embodiment of the present invention wherein rods extend up the wrist of the user and offer resistance to movement of that wrist.

The composite rods of the present invention could be extended down the length of the wrist so as to offer exercise for the wrist. An embodiment with these extended rods is shown in FIG. 10. In FIG. 10, the rods 260 extend from a first wrist wrap 69 down the wrist to the hand and are preferably supported by a second wrist wrap 70 near the hand. The rods are held against the hand by a glove 72 or other suitable means. Since the movement of the hand up and down causes the rods to flex, the wrist and forearm of the user may be exercised by the resistance of the rods to bending. The rods 260 used for the embodiment in FIG. 10 extend further up the hand and may also be used for exercising the fingers of the user. Alternatively, different rods with different flexibilities or rigidities could be used for the wrist and the fingers so that they may both be exercised at different resistances.

The exercising devices described herein are advantageous over prior art exercising devices for the wrists and hands in that these exercising devices do not require the user to grasp an exercising device while he or she is being exercised or rehabilitated. Thus, the gloves or exercising devices may be fitted such that the user is provided resistance during the ordinary course of work or play. In addition, the exercising devices do not rely on gravity and therefore may be used in space. Further, individual fingers may be rehabilitated by varying the resistance on the different fingers. In addition, if a composite system such as the S2-glass is used, variable resistance is offered to the lower arm muscles.

While this invention has been described in detail with particular reference to preferred embodiments thereof, it will be understood that variations and modifications can be affected within the spirit and scope of the invention as described herein and before and as described in the appended claims.

What is claimed is:

1. A device for exercising a hand of the user, said device comprising:

a glove of moderately extensible material;

at least one flexible, resilient, substantially inextensible rod formed of a composite material having a variable resistance to bending and being sized and configured to extend continuously approximately from a tip of a finger to at least the base of the hand;

at least one substantially inextensible sleeve attached to the glove and being configured to extend continuously approximately from a tip of a finger to at least the base of the hand, said sleeve including one open end near the base of the hand for slidably accommodating said at least one rod such that the rod may adapt to and maintain the curvature of the hand upon bending of the hand;

wherein said at least one rod is slidably disposed within said at least one sleeve and configured such that in an initial, relaxed orientation the rod biased the finger into an open, or substantially straight, position such that the resistance to bending of said at least one rod opposes bending of the at least one rod out of the relaxed initial orientation and into a bend orientation and thereby resists flexing of the muscles of the finger and causes the hand to be exercised, the flexibility allows said at least one rod to bend responsive to the flexing of the finger and the resiliency biases said at least one rod after the flexing of the finger back into said initial orientation.

2. The device of claim 1, wherein said rod is slidably anchored to the back side of the hand.

3. The device of claim 1, wherein said rod comprises a composite comprising S2-glass and an epoxy matrix.

4. The device of claim 1, further comprising a plurality of said rods, said rods configured to extend up the fingers of the user.

5. The device of claim 4, wherein said at least one sleeve comprising four sleeves, each of said sleeves configured to extend from approximately an upper end of a finger down to approximately the wrist area of said glove, and each of said sleeves being adapted to receive at least one of said rods.

6. The device of claim 4, wherein said rods are formed together at a palm area of the hand and separately extend up the fingers of the user.

7. The device of claim 6, wherein said at least one sleeve comprises a sleeve adapted for receiving said four rods, said sleeve extending from approximately the upper ends of the fingers up which said rods extend to an area in the proximity of the wrist area of the glove.

8. The device of claim 1, wherein said glove further comprises antimicrobials.

9. The device of claim 1, wherein said at least one rod further comprises antimicrobials.

* * * * *